US008001670B2

(12) United States Patent
Gory

(10) Patent No.: US 8,001,670 B2
(45) Date of Patent: Aug. 23, 2011

(54) METHOD FOR ASSEMBLING AT LEAST TWO ELEMENTS BY MEANS OF A CRIMPING RIVET

(75) Inventor: Philippe Gory, Saint Thibaud de Couz (FR)

(73) Assignee: Bollhoff Otalu S.A., La Ravoire (FR)

( * ) Notice: Subject to any disclaimer, the term of this patent is extended or adjusted under 35 U.S.C. 154(b) by 855 days.

(21) Appl. No.: 12/010,276

(22) Filed: Jan. 23, 2008

(65) Prior Publication Data

US 2008/0209711 A1 Sep. 4, 2008

(30) Foreign Application Priority Data

Feb. 13, 2007 (FR) ..... 07 01015

(51) Int. Cl.
*B21J 15/02* (2006.01)
*B21J 15/04* (2006.01)

(52) U.S. Cl. ..... 29/524.1; 29/525.05; 29/525.06; 29/243.521; 29/243.53; 403/282

(58) Field of Classification Search ..... 29/432.1, 29/524.1, 525.05, 525.06, 243.521, 243.53
See application file for complete search history.

(56) References Cited

U.S. PATENT DOCUMENTS 3,838,499 A 10/1974 Fuller
6,990,722 B2 * 1/2006 Reid et al. ..... 29/522.1

* cited by examiner

*Primary Examiner* — Jermie Cozart
(74) *Attorney, Agent, or Firm* — Oliff & Berridge, PLC

(57) ABSTRACT

A method for assembling at least two elements by a crimping rivet including a head and a stem, and an associated fitting tool including a traction rod. The method includes the following successive steps. A securing step that secures a part of the stem of the rivet by die-stamping on a corresponding part of the traction rod of the fitting tool inserted inside the stem of the rivet. An inserting step that inserts the rivet in corresponding holes of the elements to be assembled. A crimping step that crimps the rivet by the fitting tool. A separating step that separates the fitting tool by radial deformation of the part of the stem on which die-stamping was applied.

6 Claims, 2 Drawing Sheets

METHOD FOR ASSEMBLING AT LEAST TWO ELEMENTS BY MEANS OF A CRIMPING RIVET

BACKGROUND OF THE INVENTION

The invention relates to a method for assembling at least two elements by means of a crimping rivet comprising a head and a stem, and an associated fitting tool, the method comprising at least the steps of:

inserting the rivet in corresponding holes of the elements to be assembled, and crimping of the rivet by the fitting tool, a method comprising, before the step of inserting the rivet in the corresponding holes of the elements to be assembled, a step of securing a part of the stem of the rivet by die-stamping to a corresponding part of a traction rod of the fitting tool, inserted inside the stem of the rivet, and a separation step of the fitting tool from the rivet.

STATE OF THE ART

For fixing at least two panel, board or similar elements, a known method for assembling conventionally uses a blind crimped rivet with incorporated shank. As represented in FIG. 1, such a rivet 10 conventionally comprises a head 11 and a body 12 designed to deform so as to form a crimping upset securing the assembled panels between said upset and the head 11. The rivet 10 also comprises an incorporated shank 13 designed to be inserted in an associated fitting tool (not represented in FIG. 1) for the purposes of performing the crimping operation.

The method for assembling the two elements then comprises insertion of rivet 10 in corresponding holes of the elements to be assembled. Then shank 13 is inserted in one end of the fitting tool to perform the rivet crimping step. After crimping, shank 13 is eliminated by breaking substantially at the level of head 11 of rivet 10.

Even though such an assembly method is relatively simple and quick, it does not however provide full guarantees in particular from the point of view of optimization of assembly and positioning of the rivet in the assembled elements. More particularly, shank 13 remaining after breaking has to be eliminated and rivet 10 fitted after crimping presents a very random hold, body 12 in particular being able to vibrate in use in the assembled elements. Moreover, deformation of rivet 10 does not guarantee pressing of the assembled elements, and tightness between shank 13 and rivet 10 is difficult to obtain. Automatic distribution and fitting of such a rivet 10 are also difficult to achieve.

The document U.S. Pat. No. 3,838,499 describes a method for assembling two elements by means of a rivet, in which a traction rod of a fitting tool is attached by die-stamping to a part of the stem of the rivet, the rivet then being inserted in the corresponding holes of the elements to be assembled. The method is completed by a rivet crimping step and a separation step of the fitting tool from the rivet. The crimping step is performed by radial deformation of the part of the stem on which die-stamping was applied. The separation step of the fitting tool is performed at the same time as the crimping step, because the radial deformation creating the crimping upset is at the same time accompanied by a progressive decrease of the tensile strength. The document mentions the possibility of unscrewing the rod so as not to damage the rivet if the latter is to act as a nut. The separation step is therefore continued after the end of the crimping step by an axial tearing of the inside face of the die-stamped part of the stem. In other words, the separation step comprises on the one hand a first sub-step simultaneous to the crimping step and performed by radial deformation of the part of the stem on which die-stamping was applied, and on the other hand by a second sub-step performed after the crimping step by axial tearing of the inside face of the die-stamped part of the stem.

This assembly method is not fully satisfactory, as the second sub-step of the separation step is liable to damage the assembly performed beforehand during the crimping step, in particular damaging the quality of the crimping upset, as it is performed by deformation of the die-stamped part of the stem, where the axial tearing takes place.

OBJECT OF THE INVENTION

The object of the invention is to improve existing methods for assembling.

The method for assembling of the invention is remarkable in that the separation step of the fitting tool from the rivet is performed after the rivet crimping step, by radial deformation of the part of the stem of the rivet on which die-stamping was applied.

The method for assembling of the invention enables sequential fitting of the rivet by successively performing a first radial deformation for the crimping step, followed by a second radial deformation, different from the first, for the separation step.

In a very advantageous alternative embodiment, in the crimping step, a crimping upset is achieved by radial deformation of a part of the stem located between the head and the part of the stem to which die-stamping was applied. This results in the separation step performed subsequently by deformation of the die-stamped part not causing any damage to the crimping upset, as the latter is axially distant from the die-stamped part.

According to one feature of the invention, the die-stamping step is performed at the level of the free end of the stem of the rivet over a predetermined height.

BRIEF DESCRIPTION OF THE DRAWINGS

Other advantages and features will become more clearly apparent from the following description of a particular embodiment of the invention, given for non-restrictive example purposes only, and represented in the accompanying figures on which.

DESCRIPTION OF A PREFERRED EMBODIMENT OF THE INVENTION

Figure 1:
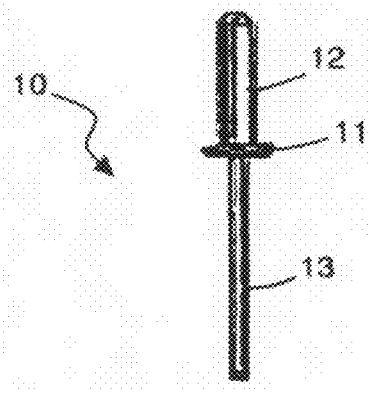
FIG. 1 represents a blind rivet with an incorporated shank used for performing a method for assembling at least two elements according to the prior art.
Figure 2:
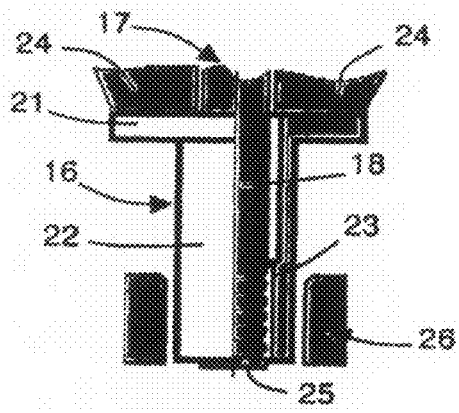
FIG. 2 schematically represents a front view in a partial cross-section of a step of a particular embodiment of a method for assembling according to the invention.
Figure 3:
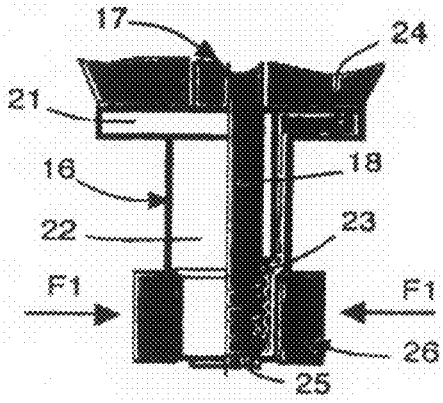
FIG. 3 schematically represents a front view in a partial cross-section of another step of the particular embodiment of the method for assembling according to the invention.
Figure 4:
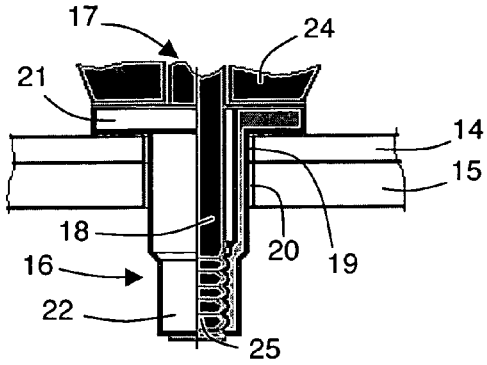
FIG. 4 schematically represents a front view in a partial cross-section of another step of the particular embodiment of the method for assembling according to the invention.

With reference to FIGS. 2 to 7, the method for assembling according to the invention is in particular designed for assembling at least two elements 14, 15, for example panels, boards or the like, by means of a crimped rivet 16 and a fitting tool 17 (FIGS. 2 and 4). The principle of the method for assembling according to the invention consists in particular in securing a part of rivet 16 by die-stamping on a traction rod 18 of fitting tool 17 before rivet 16 is inserted in holes 19, 20, respectively, of elements 14, 15 to be assembled, and crimping of rivet 16, to guarantee assembly of the two elements 14, 15.

In the particular embodiment represented in FIGS. 2 to 7, rivet 16 used for the method for assembling is a conventional rivet comprising a flat head 21 and a stem 22 that is preferably cylindrical, drilled and open (FIG. 2) and preferably comprising a die-stamping zone 23 inside stem 22. Rivet 16 is made from a material that is able to deform for the die-stamping operation, for example steel, stainless steel, brass or aluminium.

Fitting tool 17 comprises an anvil 24 placed on each side of traction rod 18 and designed to press on head 21 of rivet 16 when assembly of the two elements 14 and 15 is performed. In the particular embodiment of FIGS. 2 to 7, traction rod 18 is designed to be inserted inside rivet 16 and comprises an end 25 which is for example grooved. The die-stamping operation for securing rivet 16 on traction rod 18 is performed at the level of the free end of stem 22 of rivet 16, opposite from the head 21, so as to cooperate in particular with grooved end 25 of traction rod 18 (FIG. 3).

In alternative embodiments that are not represented, stem 22 of rivet 16 can be blind and/or can comprise an external shoulder situated under head 21 of rivet 16. Head 21 of rivet 16 can be thin or countersunk and traction rod 18 can comprise a threaded or conical end 25.

The method for assembling the two elements 14 and 15 by means of rivet 16 and fitting tool 17 will be described in greater detail with regard to FIGS. 2 to 7. In FIG. 2, the first step of the method consists in positioning head 21 of rivet 16 against anvil 24, for example made of steel, of fitting tool 17 and in positioning rivet 16 in a die-stamping tool 26 formed for example by two or more steel sectors shaped into the required form for die-stamping on rivet 16.

In FIG. 3, the next step consists in performing the die-stamping operation, i.e. applying a radial force in the direction of arrows F1 on the external surface of stem 22 of rivet 16 over a predefined height corresponding in particular to the height of the sectors of die-stamping tool 26. The die-stamping step enables rivet 16 to be secured to traction rod 18 of fitting tool 17, the material inside rivet 16 placing itself into the grooves of end 25 of traction rod 18 of fitting tool 17. In the particular embodiment of FIGS. 2 to 7, the die-stamping height corresponds substantially to the height of end 25 of traction rod 18 of fitting tool 17 and of die-stamping zone 23 inside stem 22 of rivet 16. Moreover, the end of the die-stamping step is in particular determined by the sectors of die-stamping tool 26 coming into contact.

In FIG. 4, rivet 16 thus secured to traction rod 18 is then removed from die-stamping tool 26 and placed in corresponding holes 19, 20 of elements 14 and 15 to be assembled. The diameter of holes 19, 20 of elements 14, 15 is in particular chosen such as to be slightly larger than the diameter of stem 22 of rivet 16. Furthermore, the height of rivet 16 is also calculated such that the sum of the thicknesses of elements 14 and 15 to be assembled is compatible with the crimping operation of rivet 16, i.e. with creation of a crimping upset as described hereafter. In other words, the height of stem 22 is such that, after the die-stamping operation, a non-deformed part of stem 22 remains between head 21 and the part of stem 22 on which die-stamping was applied, this non-deformed part having a height that is greater than the sum of the thicknesses of elements 14 and 15. More precisely, the difference between the height of the non-deformed part and the sum of the thicknesses of elements 14 and 15 is chosen such as to enable subsequent creation of a crimping upset.

Figure 5:
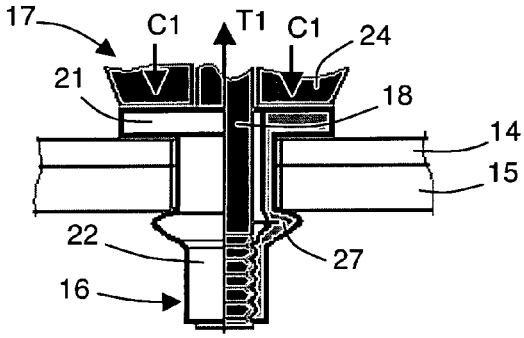
FIG. 5 schematically represents a front view in a partial cross-section of another step of the particular embodiment of the method for assembling according to the invention.

In FIG. 5, the next step of the method is the crimping step of rivet 16 in elements 14, 15 to be assembled. The crimping step consists in applying a tractive force, in the direction of arrow T1, on traction rod 18 in opposition with application of a compressive force, in the direction of arrows C1, of anvil 24 on head 21 of rivet 16 so as to obtain a crimping upset 27 characteristic of the crimping operation. Upset 27, formed under element 15, is then designed to block the two elements 15, 16 against one another and between itself and head 21 of rivet 16. As described previously, the height of stem 22 of rivet 16 and of the die-stamped zone of rivet 16 on traction rod 18 are in particular calculated such that stem 22 keeps a sufficient height able to deform to obtain crimping upset 27, as represented in FIG. 5: in the crimping step, crimping upset 27 is produced by a radial deformation of a part of stem 22 located between head 21 and the part of stem 22 on which die-stamping was applied. More precisely, crimping upset 27 is generated by a radial deformation of a segment of the part of stem 22 that was not deformed during the die-stamping step, i.e. the segment directly adjacent to the part of stem 22 on which die-stamping was applied. The remaining segment of the part of stem 22 not deformed during the die-stamping step, i.e. the segment located between head 21 and crimping upset 27, presents a height that is substantially equal to the sum of the thicknesses of elements 14, 15, and remains intact in the crimping step.

Figure 6:
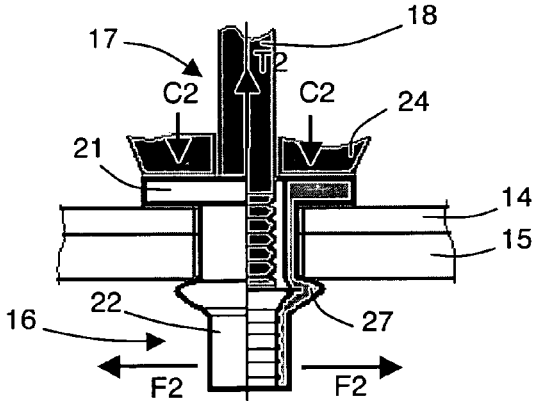
FIG. 6 schematically represents a front view in a partial cross-section of another step of the particular embodiment of the method for assembling according to the invention.

In FIG. 6, the method for assembling then comprises a separation step of fitting tool 17 from rivet 16. The separation step consists in applying a tractive force in the direction of arrow T2 on traction rod 18 of fitting tool 17, and a compressive force in the direction of arrows C2 on anvil 24, which forces are different from the tractive force (arrow T1) and compressive force (arrows C1) of the crimping step represented in FIG. 5.

The separation step is performed in particular from a calibrated force of fitting tool 17. Thus for the separation step of fitting tool 17, the tractive force according to arrow T2 (FIG. 6) is preferably greater than the tractive force according to arrow T1 (FIG. 5), and the compressive force according to arrows C2 (FIG. 6) is greater than the compressive force according to arrows C1 (FIG. 5). Calibration of this kind with tractive and compressive forces depending on the steps of the method in particular guarantee optimal crimping of rivet 16 in the two elements 14 and 15.

Such forces applied by fitting tool 17 then result, in the direction of arrows F2, in radial deformation of stem 22 of rivet 16 and removal of the material of stem 22 initially inserted by die-stamping on end 25 of traction rod 18. This results in a progressive reduction of the tensile strength of rivet 16 which becomes almost zero, or even zero according to the applications, and extraction of traction rod 18 is then facilitated by a simple translation of fitting tool 17 out of rivet 16. Radial deformation of the part of stem 22 on which die-stamping was applied takes place between the end of stem 22 opposite head 21 and crimping upset 27.

In an alternative embodiment, not represented, in which traction rod 18 comprises a threaded end 25, the separation step of fitting tool 17 and rivet 16 can comprise an additional step of unscrewing traction rod 18 to perform complete extraction of traction rod 18 from rivet 16 after deforming of the part of the stem 22 on which die-stamping was applied. Rivet 16 can in this way be used with an additional nut function.

Figure 7:
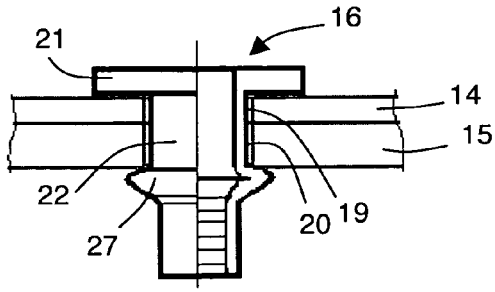
FIG. 7 schematically represents a front view in a partial cross-section of another step of the particular embodiment of the method for assembling according to the invention.

In FIG. 7, fitting tool 17 is completely withdrawn from rivet 16. The two elements 14, 15 are then solidly assembled, rivet 16 being held in position in optimal manner in corresponding holes 19, 20 of now assembled elements 14, 15.

Such a method for assembling according to the invention therefore uses a die-stamping principle whereby on the one hand rivet 16 is secured efficiently and quickly to traction rod 18, and on the other hand rivet 16 is fixed solidly in the elements to be assembled to ensure optimal assembly. The method for assembling according to the invention also uses an extraction principle of rivet 16 from fitting tool 17 after crimping that is simple, quick, and does not damage the assembly performed beforehand.

Moreover, fitting tool 17 used for such a method for assembling is simple to use whatever the shape of end 25 of traction rod 18.

In addition, rivet 16 used for the method for assembling according to the invention is a simple rivet formed by a simple hollow metal part comprising a head and a hollow tubular stem, without an incorporated traction system, i.e. an internal thread or shank. The dimensions and material of rivet 16 are able to withstand and to adapt to die-stamping treatment, i.e. they are suitable for the rivet to be able to be fitted in any type of application requiring fitting of a rivet of the blind crimped type.

In addition, the height and depth of the die-stamping performed on stem 22 of rivet 16 are such as to guarantee sequential fitting of rivet 16 by first performing crimping of rivet 16 in elements 14 and 15, and then extraction of traction rod 18, without breaking rivet 16 or traction rod 18 of fitting tool 17. Sequential fitting of rivet 16 is performed by successively making a first radial deformation (crimping upset 27) for the crimping step, then a second radial deformation, axially offset from the first deformation, for the separation step. This results in the separation step performed by deformation of the part on which die-stamping was applied not causing any damage to crimping upset 27, as the latter is axially distant from the part on which die-stamping was applied.

The invention is not limited to the embodiment described above. Rivet 16 can be made from any material able to deform by die-stamping. The dimensions and shapes of rivet 16 (head 21 and stem 22) and of fitting tool 17 are not restrictive and depend in particular on the dimensions of elements 14, 15 to be assembled and on the intended applications. The use of a blind rivet 16 in particular enables a total tightness function to be performed between the two elements 14 and 15 to be assembled, with requiring the addition of a fitted seal or a seal moulded from casting or a plastic washer under head 21 of blind rivet 16.

In addition, the length of rivet 16 and the height of the die-stamping performed on stem 22 thereof depend in particular on the diameter of rivet 16 and on the thickness of elements 14, 15 to be crimped. Rivet 16 can be secured to traction rod 18 of fitting tool 17 by any type of die-stamping method, i.e. any type of cold working of the material of rivet 16.

The invention claimed is:

1. Method for assembling at least two elements by means of a crimping rivet comprising a head and a stem, and an associated fitting tool, the method comprising in succession:

securing a first part of the stem of the rivet by die-stamping to a corresponding part of a traction rod of the fitting tool inserted inside the stem of the rivet, a thickness of the first part of the stem on which die-stamping was applied is greater than a thickness of a second part of the stem located between the first part of the stem and the head of the rivet, the second part of the stem being arranged such as to receive a radial deformation and to produce a crimping upset, inserting the rivet in corresponding holes of the elements to be assembled, crimping the rivet by the fitting tool by applying a first tractive force on the traction rod in opposition with application of a first compressive force on the head of the rivet so as to obtain the crimping upset by radial deformation of the second part of the stem, separating the fitting tool from the rivet by achieving a radial deformation of the first part of the stem by applying a second tractive force on the traction rod of the fitting tool, and a second compressive force, said second tractive force being greater than the first tractive force and said second compressive force being greater than the first compressive force.

2. The method according to claim 1, wherein the die-stamping step is performed in a radial direction surrounding a free end of the stem of the rivet at a predetermined height, the radial direction being perpendicular to a direction in which the stem extends.

3. The method according to claim 1, wherein the separating step of the fitting tool from the rivet comprises a step of unscrewing a threaded end of the traction rod.

4. The method according to claim 1, wherein the rivet comprises a die-stamping zone inside the stem corresponding to a height of the first part of the stem designed to receive the die-stamping.

5. The method according to claim 1, wherein the traction rod of the fitting tool comprises a grooved, threaded or conical end.

6. The method according to claim 1, wherein the rivet is made from a material selected from steel, stainless steel, brass or aluminium.

* * * * *